US010683581B2

(12) United States Patent
Golding et al.

(10) Patent No.: US 10,683,581 B2
(45) Date of Patent: Jun. 16, 2020

(54) METHOD FOR DEPOSITION OF TITANIUM-BASED PROTECTIVE COATINGS ON ALUMINUM

(71) Applicant: Henkel AG & Co. KGaA, Duesseldorf (DE)

(72) Inventors: James P. Golding, Saint Clair Shores, MI (US); Jacques Beauvir, Damgan (FR); Christian Rosenkranz, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/005,188

(22) Filed: Jun. 11, 2018

(65) Prior Publication Data

US 2018/0291520 A1 Oct. 11, 2018

Related U.S. Application Data

(63) Continuation of application No. PCT/EP2016/080118, filed on Dec. 7, 2016.

(60) Provisional application No. 62/267,960, filed on Dec. 16, 2015.

(51) Int. Cl.

| | |
|---|---|
| ***C25D 11/02*** | (2006.01) |
| ***C25D 9/06*** | (2006.01) |
| ***C25D 11/12*** | (2006.01) |
| *F02F 1/00* | (2006.01) |
| *F02F 3/00* | (2006.01) |

(52) U.S. Cl.

CPC ..... *C25D 9/06* (2013.01); *C25D 11/024* (2013.01); *C25D 11/026* (2013.01); *C25D 11/12* (2013.01); *F02F 1/00* (2013.01); *F02F 3/00* (2013.01)

(58) Field of Classification Search

CPC ..... C25D 11/024; C25D 11/026
USPC ..... 205/106–108
See application file for complete search history.

(56) References Cited

U.S. PATENT DOCUMENTS

| | | | | |
|---|---|---|---|---|
| 6,797,147 | B2 | 9/2004 | Dolan | |
| 7,578,921 | B2 * | 8/2009 | Dolan | C25D 5/18 205/106 |
| 2002/0112962 | A1 | 8/2002 | Beauvir | |
| 2003/0070935 | A1 | 4/2003 | Dolan | |
| 2003/0070936 | A1 | 4/2003 | Dolan | |
| 2003/0075453 | A1 | 4/2003 | Dolan | |
| 2005/0061680 | A1 | 3/2005 | Dolan | |
| 2005/0115839 | A1 | 6/2005 | Dolan | |
| 2005/0115840 | A1 | 6/2005 | Dolan | |
| 2006/0013986 | A1 | 1/2006 | Dolan | |
| 2008/0092592 | A1 | 4/2008 | Italo | |
| 2009/0098373 | A1 | 4/2009 | Dolan | |
| 2009/0258242 | A1 | 10/2009 | Dolan | |
| 2010/0000870 | A1 | 1/2010 | Dolan | |
| 2010/0252241 | A1 | 10/2010 | McDermott et al. | |
| 2013/0015072 | A1 * | 1/2013 | Hiratsuka | C25D 11/06 205/107 |
| 2013/0095317 | A1 | 4/2013 | Kramer et al. | |
| 2014/0196439 | A1 | 7/2014 | Dolan et al. | |
| 2017/0002476 | A1 * | 1/2017 | Knittel | C25D 11/024 |

FOREIGN PATENT DOCUMENTS

| | | | | |
|---|---|---|---|---|
| CN | 1623013 | A | 6/2005 | |
| CN | 103339298 | A | 10/2013 | |
| EP | 1832753 | A2 | 9/2007 | |
| WO | 0005493 | A1 | 2/2000 | |
| WO | 03029529 | A1 | 4/2003 | |
| WO | WO-2015092205 | A1 * | 6/2015 | C25D 11/024 |

OTHER PUBLICATIONS

International Search Report for PCT/EP2016/080118, dated Mar. 7, 2017.

A. L. Yerokhin, et al, "Plasma electrolysis for surface engineering, surface engineering, surface & coating technology", vol. 122 (1999), pp. 73-93, dated Apr. 9, 1999.

* cited by examiner

*Primary Examiner* — Brian W Cohen
(74) *Attorney, Agent, or Firm* — Mary K. Cameron

(57) ABSTRACT

Disclosed is a method for the plasma-electrolytic deposition of a titanium-based non-metallic protective coating on an aluminum-containing material that exhibits excellent resistance to corrosion and high resistance against wear; a coated aluminum-containing metallic article, wherein the coating comprised of oxides and hydroxides of the elements titanium and aluminum has a thickness of at least 15 microns and a cross-section hardness (HV) of at least 800; and a device comprising an arrangement of two adjacent parts at least one being selected from an aluminum-containing metallic material that is coated according to the method and in frictional connection with the other part wherein under operation the frictionally connected parts move relatively to each other, such as, pistons moving in the cylinder within the powertrain of a vehicle.

10 Claims, No Drawings

METHOD FOR DEPOSITION OF TITANIUM-BASED PROTECTIVE COATINGS ON ALUMINUM

FIELD OF THE INVENTION

The underlying invention encompasses a method for the plasma-electrolytic deposition of a titanium-based non-metallic protective coating on an aluminum-containing material that exhibits excellent resistant to corrosion and high resistance against wear. The respective method is based on the concept of applying a plurality of anodic current sequences through the aluminum-containing material during which the plasma is ignited and deposition occurs while the sequences are applied with a minimum frequency to allow the rapid formation of a protective coating with said properties. Another object of this invention consists in a coated aluminum-containing metallic article, wherein the coating comprised of oxides and hydroxides of the elements titanium and aluminum has a thickness of at least 15 microns and a cross-section hardness with a Vickers Pyramid Number (HV) of at least 800. In yet another object the invention encompasses a device comprising an arrangement of two adjacent parts at least one being selected from an aluminum-containing metallic material that is coated according to this invention and in frictional connection with the other part wherein under operation the frictional connected parts move relatively to each other, such as pistons moving in the cylinder within the powertrain of car vehicles.

BACKGROUND OF THE INVENTION

Plasma-electrolytic deposition of protective coatings on light metals is a well-established process in the prior art, especially the deposition of oxides/hydroxides of the elements Si, Zr and/or Ti on aluminum substrates.

WO 03/029529 A1 discloses a method for the plasma-electrolytic deposition from aqueous electrolytes that comprise fluorometallates of the elements Si, Zr and/or Ti. The aluminum or magnesium substrate acts as an anode in the process described therein and rapid formation of a protective coating is reported. The protective coatings are attained via pulse direct current or alternating current with a frequency ranging from 10-1000 Hertz and a current density in the range from 1-3 A/dm$^2$. The protective coatings exhibit good corrosion-, heat-, and abrasion-resistance.

However, when applying the before-mentioned plasma-electrolytic deposition method the appearance of white spots at extended times of deposition that are aimed to yield protective coating thicknesses of above 15 microns is critical. These white spots are defects in the protective coating at which corrosive attack of the beneath substrate is initiated. The appearance of white spots during the layer built up thereby also factually limits the coating thickness for which suitable corrosion resistance can be attained. In addition, a plasma-electrolytic deposition of the prior art usually reaches relatively quickly an equilibrium of corrosion rate and deposition rate so that coating thicknesses above 15 μm can only be obtained under harsh electrical conditions to uphold a voltage drop across the protective coating that allows a sustained plasma at the substrate to be further coated. These observations are especially true for the plasma-electrolytic deposition of protective coatings on the substrate aluminum. Said substrate being of outstanding economic importance due to a still increasing number of applications to which aluminum articles are essential, such as in light weight constructions being an important technology driver in automotive industry.

The objective of the underlying invention therefore consists in providing a method for the plasma-electrolytic deposition of an inorganic protective coating on aluminum-containing metallic material that enables economically reasonable deposition rates even at coating thicknesses above 15 μm while attaining protective coatings with less defects prone to corrosion and a superior coating hardness.

SUMMARY OF THE INVENTION

Said objective is solved by a method for the deposition of a protective coating on an aluminum-containing metallic material, comprising the step of applying a plurality of anodic current sequences through said metallic material while said metallic material is contacted with an acidic aqueous electrolyte comprising at least one water-soluble compound of titanium, wherein the average peak anodic current density per anodic current sequence amounts to at least 15 A/dm$^2$ and wherein the average time interval between subsequently applied anodic current sequences does not exceed 10 milliseconds.

Another object of this invention consists in a coated aluminum-containing metallic article, wherein the coating that comprises oxides and hydroxides of the elements titanium and aluminum has a thickness of at least 15 microns and a cross-section hardness with a Vickers Pyramid Number (HV) of at least 800 at a temperature of 20° C. and a load of 15 mN.

It is a further object of the invention to provide a device comprising an arrangement of two adjacent parts in frictional connection to each other wherein at least one part of the arrangement that is in frictional connection with the other part is made of:

i) an aluminum-containing metallic material wherein the surface area of the aluminum-containing metallic material that is under frictional connection with the adjacent part carries at least partially a protective coating obtained through any method of this invention, or ii) any article of this invention wherein under operation the parts move relatively to each other while their frictional connection is maintained.

DETAILED DESCRIPTION OF THE INVENTION

A protective coating obtained according to the method of this invention is non-metallic and comprises at least 20 At.-% of the element titanium ("titanium-based protective coating").

An aluminum-containing metallic material treated in a method of this invention comprises at least 50 At.-% of the element aluminum.

An aqueous electrolyte of the underlying invention contains at least 50 wt.-% water and has a specific electrical conductivity of at least 1 mScm$^{-1}$ at a temperature of 20° C.

An anodic current sequence according to this invention is characterized by an uninterrupted time period during which electrons are passed under an external electrical voltage from the electrolyte through the interface at the aluminum-containing metallic material to the metallic material acting thereby as an anode ("faradaic process"). Said anodic current sequence encompasses the adjacent time periods for capacitive charging of the interfaces prior or subsequent to the faradaic process itself. Consequently, the anodic or cathodic peak current density according to this invention is the maximum current density of the respective sign within said uninterrupted time period characterizing the current sequence.

The average anodic peak current density per anodic current sequence in the context of this invention is defined according to formula (A):

$$\overline{J_{+}^{peak}} = \frac{1}{N_{+}} \sum_{i=1}^{N+} j_{+}^{peak,i} \quad (A)$$

$j_{+}^{peak,i}$: anodic peak current density within anodic current sequence i [A/dm$^2$]

$N_{+}$: number of anodic current sequences i giving rise to the plurality of anodic current sequences.

The average time interval between subsequently applied anodic current sequences i within the plurality of anodic current sequences i in the context of this invention is defined according to formula (B):

$$\bar{t}_{pulse} = \frac{T}{N_{+}} \quad (B)$$

T: time during which number $N_{+}$ of anodic current sequences is applied (sec); and $N_{+}$: number of anodic current sequences i giving rise to the plurality of anodic current sequences.

It was surprisingly found, that through a method of this invention protective coatings can be attained with a formation rate above 3 microns/minute that can be sustained up to a coating thickness of 50 microns. The protective coatings themselves do not reveal the typical defects visible as white spots either by bare human eyes or in scanning electron microscopic imaging that give usually rise to severe corrosive attack of the metallic substrate beneath. In a further aspect, the protective coatings deposited in a method of this invention reveal unique wear resistance and a cross-section hardness with a Vickers Pyramid Number (HV) of at least 800 at a temperature of 20° C. and a load of 15 mN.

The average peak anodic current density of at least 15 A/dm$^2$ is necessary to safeguard that a plasma at the interface between the aluminum-containing metallic material and the aqueous electrolyte is ignited in at least a portion of the applied plurality of anodic current sequences. The existence of a plasma is a prerequisite for the formation of a titanium-based protective coating ("Plasma Electrolytic Deposition"). In a preferred method of this invention, the average peak anodic current density is thus at least 20 A/dm$^2$, more preferably at least 25 A/dm$^2$. On the other hand, high current densities more than necessary to ignite the plasma in connection with high electrical voltages can lead to the formation of defects in the protective coating that are prone to corrosive attack and thus detrimental to the overall performance with respect to corrosion resistance. Consequently, in a preferred embodiment of the average peak anodic current density is less than 50 A/dm$^2$.

The means of applying the plurality of anodic current sequences can be freely chosen from existing routines known to the skilled person in the art, such as alternating current, alternating current with a direct current component or pulsed direct current, e.g. through rectified alternating current, or more complex current signals, e.g. by superimposing a multitude of pulsed direct current signals with varying amplitude and/or frequency. Analogously, the current sequences of this invention can be applied under voltage or current control. In the context of this invention the plurality of anodic current sequences is applied to the aluminum-containing metallic material via pulsed direct current.

It is however necessary that the power source outputs a current signal that does effect a plurality of current sequences during which the required average peak anodic current density is applied to the aluminum-containing material. In a preferred embodiment of the method of this invention during at least 50%, more preferably at least 70% of the anodic current sequences of the plurality of anodic current sequences a peak anodic current of at least 15 A/dm$^2$, more preferably 20 A/dm$^2$, even more preferably 25 A/dm$^2$ is applied to the aluminum-containing metallic material.

The overall electrical circuit does encompass a counter-electrode preferably in contact with the same aqueous electrolyte as the aluminum-containing material. The counter-electrode can be freely selected from any material with a sufficient electrical conductivity and is preferably selected from dimensionally stable electrodes known from the chlor-alkali electrolysis, inert electrodes, such as gold or platinum, stainless steel or from an aluminum-containing metallic material. It is as well preferred to set-up an arrangement where the ratio of the contact areas of the aluminum-containing material and the counter-electrode with the aqueous electrolyte is smaller than 0.1, more preferably smaller than 0.01 in order to realize a homogenous current density and thus a homogenous deposition of the protective coating at each surface portion of the aluminum-containing metallic material and as well to minimize the current density at the counter-electrode.

In a method for the plasma-electrolytic deposition according to this invention comparatively high film thicknesses can be achieved without the need to drastically increase the electrical power to sustain a plasma during the anodic current sequences. In this respect, it is mandatory that the average time interval between subsequently applied anodic current sequences does not exceed 10 milliseconds and preferably is below 10 milliseconds and even more preferably below 5 milliseconds. Nevertheless, a minimum uninterrupted time period during which a plasma is ignited through a faradaic process is oftentimes mandatory to yield a reasonable coating formation rate and to attain the characteristic coating properties, such as hardness and corrosion resistance. In a preferred embodiment of this invention the average time interval between subsequently applied anodic current sequences is thus above 0.6 milliseconds, more preferably above 0.8 milliseconds, even more preferably above 1 millisecond and especially preferred above 2 milliseconds.

The reduction of defects in the plasma-electrolytically deposited protective coating, e.g. visible white spots on a micron to sub-millimeter scale, is one of objectives of the underlying invention. It was found that the appearance of these defects can be further decreased by adapting the balance of the anodic current sequences interrupted by a certain time interval where no anodic current is passed through the aluminum-containing metallic material.

The proportion of the average duration of an anodic current sequence to the average time interval between subsequently applied anodic current sequences is therefore crucial and equals in percentages the following equation (C.1):

$$\overline{t_+}\ (\%) = \frac{100}{T}\int_0^T u(t)dt \tag{C.1}$$

T: time during which number $N_+$ of anodic current sequences is applied (sec);

u(t): so-called unit step function as defined below (C.2) being dependent on the current density as a function of time j(t) that is passed through the aluminum-containing metallic material $$u(t) := \begin{cases} 1: & j(t) > 0 \\ 0: & j(t) \leq 0 \end{cases} \tag{C.2}$$

As a result, in a preferred method of this invention the proportion of the average duration of an anodic current sequence to the average time interval between subsequently applied anodic current sequences shall not exceed the following term (C.3) in percentages:

$$40\% \cdot \log_{10}\frac{1}{\bar{t}_{pulse}} - 35\% \tag{C.3}$$

$\bar{t}_{pulse}$: average time interval between subsequently applied anodic current sequences (sec).

On the other hand, for the sake of economy, the time interval during which no anodic current is passed through the aluminum-containing metallic material should be as short as possible to allow quick processing of the materials to be coated. Therefore, a method of this invention is preferred wherein the proportion of the average duration of an anodic current sequence to the average time interval between subsequently applied anodic current sequences amount to at least the following term (C.4) in percentages:

$$40\% \cdot \log_{10}\frac{1}{\bar{t}_{pulse}} - 75\% \tag{C.4}$$

$\bar{t}_{pulse}$: average time interval between subsequently applied anodic current sequences (sec).

It was observed that protective coatings with an exceptional cross section hardness of at least 800 HV at a coating thickness of at least 15 microns can be attained under conditions where in between a portion of the subsequently applied anodic current sequences the aluminum-containing metallic material is cathodically polarized. Moreover, the appearance of white spots being detrimental to the corrosion resistance of the protective coating is further decreased thereby. A method of this invention is thus preferred wherein between at least 20%, preferably between at least 40%, more preferably between at least 60%, even more preferably at least 80% of all successive anodic current sequences a cathodic current sequence is applied to the metallic material. In this context, it is further preferred that the average peak cathodic current density per cathodic current sequence amounts to not more than 50%, preferably not more than 30%, but preferably amounts to at least 10% of the average anodic peak current density applied per anodic current sequence. The average peak cathodic current density per cathodic current sequence in the context of this invention is defined according to formula (D):

$$\overline{J_-^{peak}} = \frac{1}{N_-}\sum_{i=1}^{N-} j_-^{peak,i} \tag{D}$$

$j_-^{peak,i}$: cathodic peak current density within cathodic current sequence i [A/dm$^2$]

N−: number of cathodic current sequences i

In order to further optimize the performance of the protective coating especially with regard to hardness and thus abrasive wear resistance a method of this invention is preferred wherein the proportion of the duration of cathodic current sequences is at least 20%, preferably at least 50% of the overall transition time between anodic current sequences.

The proportion of the overall transition time between anodic current sequences to the time interval during which the number $N_+$ ("plurality") of anodic current sequences is applied in the context of this invention is defined according to formula (E):

$$t_{trans}\ (\%) = 100 - \frac{100}{T}\int_0^T u(t)dt \tag{E}$$

T: time during which number $N_+$ of anodic current sequences is applied in seconds u(t): so-called unit step function as defined before according to formula (C.2).

In addition to these electrical parameters that may further define the method of this invention and as a consequence yield the desired coating properties, the composition of the aqueous electrolyte does also influence the elemental constitution of the protective coating and thus its properties in light of the general objectives of this invention.

A water-soluble compound of the element titanium comprised in said aqueous electrolyte is water-soluble in the context of this invention if at least 1 g/L of the respective compound calculated on the basis of the element titanium can be added to deionized water (⌉<1 μScm$^{-1}$) with a temperature of 20° C. either until an increase in the specific electrical conductivity upon further adding an amount of the respective compound does no longer occur or precipitates are formed within one hour of stirring.

The water-soluble compound of titanium is generally not limited and may be selected from solely inorganic compounds such as titanyl sulfate as well as titanium complexes with organic ligands. Suitable complexes are titanium acetylacetonate or titanyl alkoxides such as titanium tetraisopropoxide as well as oxalates or citrates. However, inorganic compounds are often preferred in the method of this invention due to their inherent properties to dissolve under formation of hydrated ions and thus to sustain the electrical current through the aqueous electrolyte. In this respect, those inorganic compounds of the element titanium are especially preferred in a method of this invention that upon solvation yield hydrated anions comprised of the element titanium. It is ensured thereby, that upon formation of the protective coating during the anodic current sequences migration of titanium species occurs towards the aluminum-containing metallic material that simultaneously absorbs titanium from the electrolyte.

Water-soluble compounds of the element titanium that upon solvation in water yield hydrated anions are complex fluorides or oxyfluorides of titanium. Such compounds are thus preferably comprised in the aqueous electrolyte of the underlying invention. These complex fluorides and oxyfluorides (sometimes referred to by skilled persons in the field as "fluorometallates") preferably are substances with molecules having the following general empirical formula (I):

$$H_pTi_qF_rO_s \quad (I)$$

wherein: each of p, q, r, and s represents a non-negative integer; r is at least 1; q is at least 1; and (r+s) is at least 6. One or more of the hydrogen atoms may be replaced by suitable cations such as ammonium, metal, alkaline earth metal or alkali metal cations (e.g., the complex fluoride may be in the form of a salt, provided such salt is water-soluble). Illustrative examples of suitable complex fluorides include, but are not limited to $H_2TiF_6$ and salts (fully as well as partially neutralized) and mixtures thereof. Examples of suitable complex fluoride salts include $(NH_4)_2TiF_6$, $MgTiF_6$, $Na_2TiF_6$ and $Li_2TiF_6$.

Suitable complex oxyfluorides of titanium may be prepared by combining at least one complex fluoride of titanium with at least one compound which is an oxide, hydroxide, carbonate, carboxylate or alkoxide of at least one element selected from the group consisting of Ti, Zr, Hf, Sn, B, Al, or Ge. Examples of suitable compounds of this type that may be used to prepare the anodizing solutions of the present invention include, without limitation, titanyl sulfate, zirconium basic carbonate, zirconium acetate and zirconium hydroxide.

The total amount of the water-soluble compound of titanium in the aqueous electrolyte preferably is at least 0.01 wt.-%, more preferably at least 0.05 wt.-%, even more preferably at least 0.1 wt.-% calculated on the basis of the element Ti. Generally, there is no preferred upper concentration limit, except of course for any solubility constraints. For sake of economy, the total amount of the water-soluble compound of titanium is less than 5 wt.-%, more preferably less than 2 wt.-% calculated on the basis of the element Ti.

To improve the solubility of the complex fluoride or oxyfluoride, especially at higher pH, it may be desirable to include hydrofluoric acid or a salt of hydrofluoric acid such as ammonium bifluoride in the electrolyte composition.

An acidic pH of the electrolyte is generally preferred in a method of this invention to increase the solubility of the water-soluble compound of titanium as well as to yield the unique characteristics of the titanium-based protective coating. In this context, it is even more preferred that the aqueous electrolyte in a method of this invention possesses a pH below 5.5, even more preferably below 4.5. In a further preferred embodiment of this invention, the pH of the aqueous electrolyte is above 1.5 to prevent from excessive pickling of the aluminum-containing metallic material as well as considerable dissolution of the protective coating itself.

In another particularly preferred embodiment of the invention, the aqueous electrolyte additionally includes a water-soluble phosphorus containing acid or salt, more preferably an oxyacid of the element phosphorus or a salt thereof, even more preferably phosphoric acids or a salt thereof. It was observed that the presence of these phosphorus compounds contributes to the formation of protective coatings that strongly adhere to the underlying metallic material so that wear resistance is further improved. A water-soluble compound of a phosphorus containing acid or salt is water-soluble in the context of this invention if at least 5 g/L of the respective compound calculated on the basis of the element phosphorus can be added to deionized water (– <1 $\mu Scm^{-1}$) with a temperature of 20° C. until an increase in the specific electrical conductivity upon further adding an amount of the respective compound does no longer occur.

For a sufficient uptake of phosphorus in the protective coating it is preferred that the concentration of phosphorus based on oxyacids of the element phosphorus or salts thereof in the aqueous electrolyte is at least, in increasing order of preference, 0.01, 0.02, 0.04, 0.06, 0.08, 0.10, 0.12, 0.14, 0.16 mol/L, while for sake of economy the phosphorus concentration is not more than 1.0, 0.9, 0.8, 0.7, 0.6 mol/L.

In order to expand the bath lifespan of the aqueous electrolyte under working conditions, the aqueous electrolyte may in a method of this invention also include at least one chelating agent, especially preferred a chelating agent containing two or more carboxylic acid groups per molecule such as nitrilotriacetic acid, ethylene diamine tetraacetic acid, N-hydroxyethyl-ethylenediamine triacetic acid, or diethylene-triamine pentaacetic acid or salts thereof.

A unique feature of the method of this invention consists in the fact that the deposition mechanism of the titanium-based protective coating by means of the plurality of anodic current sequences is not self-limited. Thus, the coating thickness can be considerably increased compared to conventional methods described in the prior art said feature being of course of helpful to increase the lifespan of a material with a protective coating in applications for which a high wear resistance is crucial, e.g. as a coating on cylinder liners in the power train of automobiles being exposed to severe friction. In a preferred method of this invention the step of applying a plurality of anodic current sequences is therefore sustained for a time effective to form a protective coating with a layer thickness of more than 15 microns, preferably more than 20 microns, more preferably more than 25 microns. The thickness of the protective coating can be measured through detection and analysis of the intensity of eddy currents being induced in the aluminum-containing metallic material according to DIN EN ISO 2808, method 7D with a probe head resolution of at least 0.01 $cm^2$.

Consequently, another object of the invention consists in a coated aluminum-containing metallic article, wherein the coating that comprises oxides and hydroxides of the elements titanium and aluminum has a thickness of at least 15 microns and a cross section hardness with a Vickers Pyramid Number (HV) of at least 800 and a load of 15 mN.

Generally, these type of articles are obtainable through a method of this invention in which the aqueous electrolyte comprised oxyacids of phosphorus and salts thereof that in turn gave rise to coatings that also comprised the element phosphorus. It is thus generally preferred that the article of this invention additionally comprises the element phosphorus, preferably at least 0.5 At.-%, but preferably up to 5 At.-% of the element phosphorus.

More preferably, the coating of the article of this invention comprises at least 12 At.-%, more preferably at least 25 At.-%, but preferably not more than 50 At.-% of the element titanium, and at least 16 At.-%, but preferably not more than 25 At.-% of the element aluminum.

Yet more preferably, the article of this invention is obtainable through any method according to this invention. An especially preferred article of this invention is obtainable through a method of this invention wherein the acidic aqueous electrolyte is compounded from 0.7-2.1 wt. % $H_2TiF_6$ and 0.2-0.5 wt. % $H_3PO_4$ wherein the average anodic peak current density applied during each anodic current sequence ranges from 15 to 40 $A/dm^2$, the average time interval between subsequently applied anodic current sequences ranges from 3 to 6 milliseconds, the time period of each anodic current sequence ranges from 15 to 60% of each said time interval, and the plurality of anodic current sequences is applied within 4 to 10 minutes.

As already mentioned the protective coatings attained on any aluminum-containing material exhibit a high resistance against abrasive wear and are useful in manifold devices in which friction and the related abrasive wear of frictional connected components is key to the performance of said device.

It is thus yet another object of the underlying invention to provide a device comprising an arrangement of two adjacent parts in frictional connection to each other wherein at least one part of the arrangement that is in frictional connection with the other part, preferably consisting of a material having a Young's modulus at 20° C. of at least 0.1 GPa, more preferably of at least 1 GPa, is made of i) an aluminum-containing metallic material wherein the surface area of the aluminum-containing metallic material that is under frictional connection with the adjacent part carries at least partially a protective coating obtained through any method of this invention, or ii) any article of this invention wherein under operation the parts move relatively to each other while their frictional connection is maintained.

As an example, such device can be selected from a powertrain comprising an arrangement of a cylinder and a piston that both are fabricated from an aluminum alloy and are at least partially coated with a protective coating obtainable in a method of this invention. Other examples include, but are not limited, to a brake system comprising an arrangement of brake discs and brake drums or to a pulley wherein the drums or pulley are fabricated from an aluminum alloy and are at least partially coated with a protective coating obtainable in a method of this invention.

The term "frictional connection" in the context of this invention characterizes a connection wherein a force tangential to the contact area of the two adjacent parts that is exerted solely on one part of the arrangement effects a counteracting force to the other part. Frictional connection can be realized for example by direct contact of the adjacent parts or by an arrangement where the adjacent parts are separated by a film of a liquid or a layer of solid particles or a film of a dispersion.

What is claimed is:

1. A method for the deposition of a protective coating on an aluminum-containing metallic material, comprising steps of:

applying a plurality of anodic current sequences and applying at least one cathodic current sequence through said metallic material while said metallic material is in contact with an aqueous electrolyte comprising at least one water-soluble compound of titanium, wherein average peak anodic current density per anodic current sequence amounts to at least 15 A/dm$^2$, but less than 50 A/dm$^2$; average peak cathodic current density per cathodic current sequence amounts to at least 10% and not more than 50% of the average anodic peak current density applied per anodic current sequence; and wherein the average time interval between subsequently applied anodic current sequences does not exceed 10 milliseconds.

2. The method of claim 1 wherein the average time interval between subsequently applied anodic current sequences is greater than 0.6 milliseconds, but does not exceed 5 milliseconds.

3. The method of claim 2 wherein the proportion of the average duration of an anodic current sequence to the average time interval between subsequently applied anodic current sequences does not exceed the following term in percentages:

$$40\% \cdot \log_{10} \frac{1}{\bar{t}_{pulse}} - 35\%$$

$\bar{t}_{pulse}$: average time interval between subsequently applied anodic current sequences (sec).

4. The method of claim 3 wherein the proportion of the average duration of an anodic current sequence to the average time interval between subsequently applied anodic current sequences amounts to at least the following term in percentages:

$$40\% \cdot \log_{10} \frac{1}{\bar{t}_{pulse}} - 75\%$$

$\bar{t}_{pulse}$: average time interval between subsequently applied anodic current sequences (sec).

5. The method of claim 4 wherein the average peak anodic current density is at least 20 A/dm$^2$, but less than 50 A/dm$^2$.

6. The method of claim 5 wherein the average peak anodic current density is at least 25 A/dm$^2$, and the average time interval between subsequently applied anodic current sequences is greater than 1 millisecond.

7. The method of claim 1 wherein the water-soluble compound of titanium is selected from titanyl sulfate, titanium acetylacetonate, titanyl alkoxides, titanium citrate the at least one cathodic current sequence is applied between at least 20%, of all successive anodic current sequences.

8. The method of claim 1 wherein the proportion of the duration of cathodic current sequences is at least 20% of the overall transition time between anodic current sequences.

9. The method of claim 1 wherein the step of applying a plurality of anodic current sequences is sustained for a time effective to form a protective coating on the aluminum-containing metallic material having a layer thickness of more than 15 microns.

10. The method of claim 1 wherein the electrolyte further comprises oxyacids of the element phosphorus and has a pH below 5.5.

* * * * *